US007121983B1

(12) United States Patent
Trent

(10) Patent No.: US 7,121,983 B1
(45) Date of Patent: Oct. 17, 2006

(54) HAND EXERCISER

(75) Inventor: Steven Trent, Tallmadge, OH (US)

(73) Assignee: Power Web International, Tallmadge, OH (US)

( * ) Notice: Subject to any disclaimer, the term of this patent is extended or adjusted under 35 U.S.C. 154(b) by 173 days.

(21) Appl. No.: 10/641,528

(22) Filed: Aug. 14, 2003

Related U.S. Application Data

(60) Provisional application No. 60/406,549, filed on Aug. 27, 2002.

(51) Int. Cl.
*A63B 23/16* (2006.01)
*A63B 21/02* (2006.01)

(52) U.S. Cl. ..... 482/47; 482/121

(58) Field of Classification Search ..... 482/44–50, 482/121–126; 473/524–557
See application file for complete search history.

(56) References Cited

U.S. PATENT DOCUMENTS

| | | | | |
|---|---|---|---|---|
| 2,080,642 A | | 5/1937 | Timpe | |
| 3,265,389 A | | 8/1966 | Carlson | |
| 3,326,550 A | | 6/1967 | Melchiona | |
| 3,341,201 A | | 9/1967 | Ryan | |
| 3,820,785 A | * | 6/1974 | Occhipinti et al. | 473/463 |
| 4,033,582 A | | 7/1977 | Linden | |
| 4,318,875 A | | 3/1982 | Shrimpton | |
| 4,379,554 A | | 4/1983 | Schuyler | |
| 4,549,736 A | | 10/1985 | Lotfy | |
| 4,750,734 A | * | 6/1988 | Greenfield | 482/47 |
| 5,013,030 A | * | 5/1991 | Frins | 482/47 |
| 5,035,429 A | * | 7/1991 | Redrow | 473/553 |
| 5,419,963 A | * | 5/1995 | Kuebler | 428/364 |
| 5,492,525 A | * | 2/1996 | Gibney | 601/40 |
| 5,961,404 A | * | 10/1999 | Gormley | 473/530 |
| 5,984,837 A | * | 11/1999 | Weaver et al. | 482/35 |
| 6,110,075 A | * | 8/2000 | Woodruff | 482/47 |
| 6,551,216 B1 | * | 4/2003 | Rennex | 482/35 |

* cited by examiner

*Primary Examiner*—Gregory Huson
*Assistant Examiner*—Fenn C. Mathew
(74) *Attorney, Agent, or Firm*—Brouse McDowell; Daniel A. Thomson

(57) ABSTRACT

A new and improved method and apparatus for exercising the hand is disclosed herein. A stretchable web, with an array of spaced apertures is molded over a rigid frame. The web has multiple portions, wherein each portion is made of a different material with different resistance levels.

14 Claims, 2 Drawing Sheets

HAND EXERCISER

This application claims priority to provisional application Ser. No. 60/406,549, entitled HAND EXERCISER, filed Aug. 27, 2002.

I. BACKGROUND OF THE INVENTION

A. Field of Invention

This invention relates to hand exercisers and more particularly to exerciser devices for use in strengthening and therapy of the muscles of the forearm, wrist, hand and fingers.

B. Description of the Related Art

Hand exercise units, herein generally termed hand exercisers, are well known devices employed in the exercising of the muscles. The muscles are brought into operation in the forearm, hand, wrist and fingers as a result of contraction of the hand against the resistance of the hand exercise unit. This resistance is generally offered by steel elements under tension, such as springs, or by rubber balls to be gripped by the hand. These devices are intended to accommodate the hand but are generally limited to a single range of movement as the devices are forced to contract. This limited range of movement accordingly limits the benefit that can be achieved in carrying out exercises using such exercisers. The form of contraction resistance facility offered by the devices soon leads, on repeated use of the device, to those muscles which are exercised achieving a stale condition, nullifying any neuromuscular stimulation which has been achieved and correspondingly nullifying any progress which has taken place. It is a universally acknowledged fact in physiotherapy that neuromuscular progress is dependent on the ability to stimulate muscles from different angles with use of different exercises and training principles.

There are a few provisions for accommodating all the movements associated with the anatomy in question in a single hand exerciser. For example, U.S. Pat. No. 4,750,734 to Greenfield discloses a hand exerciser that provides for a wide variety of neuromuscular responses in physiotherapy and muscle building in a single device. The Greenfield patent further discloses that different resistance levels can be experienced within the hand exerciser depending on the location of the apertures with respect to the ring. However, the varying degree of resistance is limited due to the uniform nature of the material used to form the hand exerciser. The Greenfield patent also discloses that different resistances can be applied to different sectors on the web. However, this is achieved by using an external frame with adjustable tensioning devices. The present invention addresses these issues by creating a hand exerciser made from multiple materials wherein each material consists of a different elasticity modulus. Therefore, a wide range of resistance levels can be provided for with a single hand exerciser without the need for an external force to vary the resistance of the web.

II. SUMMARY OF THE INVENTION

According to one aspect of the present invention, an exercise apparatus includes a rigid frame, a resiliently deformable web tensioned to the frame, the web being comprised of an array of apertures sized to accommodate human fingers, wherein the web has at least a first portion and at least a second portion, wherein the first and the portions are made of materials with different resistance levels.

In accordance with another aspect of the present invention, the web has multiple portions, wherein each portion is made of different material, with a different resistance level.

In accordance with another aspect of the present invention, the web is molded around the frame.

In accordance with another aspect of the present invention, the apertures on the at least a first portion are a different shape than the apertures on the at least a second portion, and the different shapes have different resistance levels.

In accordance with another aspect of the present invention, the web has multiple portions, wherein each portion's apertures are a different shape than the apertures on the other portions.

In accordance with another aspect of the present invention, a method for exercising includes the steps of providing a web with at least a first portion and at least a second portion, wherein the first and second portions are made of materials with different resistance levels, molding the web onto a substantially rigid frame, inserting associated fingers into the apertures, pulling the web toward an associated body, and releasing the tension on the web.

In accordance with another aspect of the present invention, providing a web with at least a first portion and at least a second portion, wherein the first and second portions are made of materials with different resistance levels further includes the step of providing a web with multiple portions, wherein the portions are made of materials with different resistance levels.

In accordance with another aspect of the present invention, providing a web with at least a first portion and at least a second portion, wherein the first and second portions are made of materials with different resistance levels further includes the step of providing a web with at least a first portion and at least a second portion, wherein the apertures of the first and second portions are different shapes with different resistance levels.

In accordance with another aspect of the present invention, providing a web with at least a first portion and at least a second portion, wherein the apertures of the first and second portions are different shapes with different resistance levels further includes the step of providing a web with multiple portions, wherein the apertures of the portions are different shapes with different resistance levels.

Other objects and advantages of the invention will appear from the following detailed description of the preferred embodiment of the invention with reference being made to the accompanying drawings.

III. BRIEF DESCRIPTION OF THE DRAWINGS

The invention may take physical form in certain parts and arrangement of parts, at least one embodiment of which will be described in detail in this specification and illustrated in the accompanying drawings which form a part hereof and wherein.

IV. DESCRIPTION OF THE INVENTION

According to the present invention, there is provided a hand exerciser for multi-movement exercising of the muscles of the forearm, hand, wrist and fingers, which comprises a rigid frame spanned by a resiliently deformable web held under tension and formed with an array of apertures sized to accommodate the human fingers, the web material being an elastomer having elasticity and hardness properties which render it capable of offering variable resistance to deformation according to the positions of fingers inserted in the apertures.

The material from which the web is produced will generally be a thermoplastic rubber or elastic plastics elastomer. Such material preferably has a Shorr A hardness of 20 degrees to 80 degrees, an elasticity modulus from 1 to 10 $MN/m^2$, a tensile strength from 7 to 35 $MN/m^2$ and an elongation at break of 100% to 1000%. In the preferred embodiment the Shorr A hardness ranges from 40 to 60 and the tensile strength ranges from 10 to 30 $MN/m^2$. A typical such material is the product MA198 from BTR Limited. The web may be of sheet form with openings stamped or otherwise formed therein or may be a mesh formed of strands of material as aforesaid crossing over at regular intervals and interconnected at the crossover positions.

The web may be made from a wide variety of materials that meet the requirement of being resilient. In general these include elastomeric materials whether vulcanized or unvulcanized, cross-linked or non-cross-linked or containing a cross-linked or partially cross-linked component. The term vulcanized is used to imply the use of heat and possibly pressure in forming a three-dimensional molecular network, while cross-linking covers the formation of a three-dimensional molecular network at any temperature. The composition utilized to produce the web having physical characteristics as aforesaid may contain the usual additives for providing protection against water, ozone and weathering, reinforcing fillers, inert fillers, colorants, anti-abrasion agents etc.

The present invention is formed by molding the web around a rigid frame whereby the molding composition becomes disposed and cured. This is a particularly suitable procedure when the web is of sheet form, such a form of exerciser being relatively inexpensive to produce and nevertheless capable of permitting a wide variety of muscle movement according to direction of stressing, thickness of web and percentage area of cells in the vicinity of the cells through which the fingers are placed.

Figure 1:
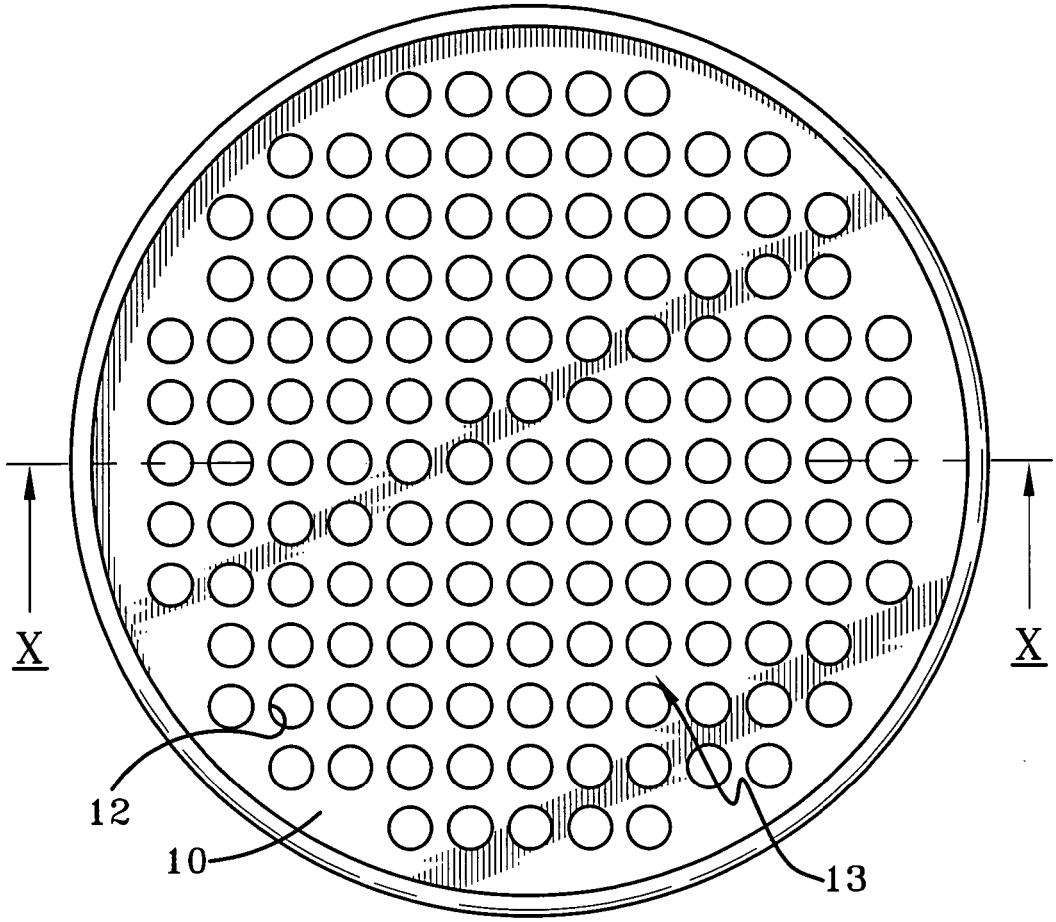
FIG. 1 is a plan view of a molded hand exerciser of the present invention.
Figure 2:
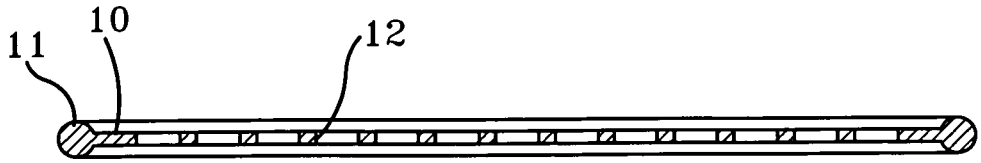
FIG. 2 is a cross-section view of FIG. 1 taken at X—X.

The preferred embodiment is shown in FIGS. 1 and 2. The hand exerciser is formed as an integral molding comprising a sheet 10 of a rubber composition molded over and between a circular ring 11 and formed with an array of apertures 12 each sized to receive a finger or thumb. The molded rubber inside the ring 11 that contains the apertures 12 is referred to as the web 13.

As mentioned above in the related art section different levels of resistance will be felt at different parts of the web 13, depending on the location of the apertures 12 in relation to the ring 11. However, in order to achieve a maximum amount of resistance levels within a single hand exerciser the web 13 can be made from multiple materials wherein each material has a different elasticity modulus. For example, one half of the web can be made of a material that has an elasticity modulus 3 $MN/m^2$ and a second material that has an elasticity modulus of 6 $MN/m^2$. In this embodiment each half of the hand exerciser will have a different resistance level. This allows the person using the device the ability to realize a wide variety of resistance levels than would be permitted in a hand exerciser made from one material. It should be noted that the number of different materials used to make the web on a single exerciser is not limited to two and can be any number of materials chosen with sound engineering judgment.

Figure 3:
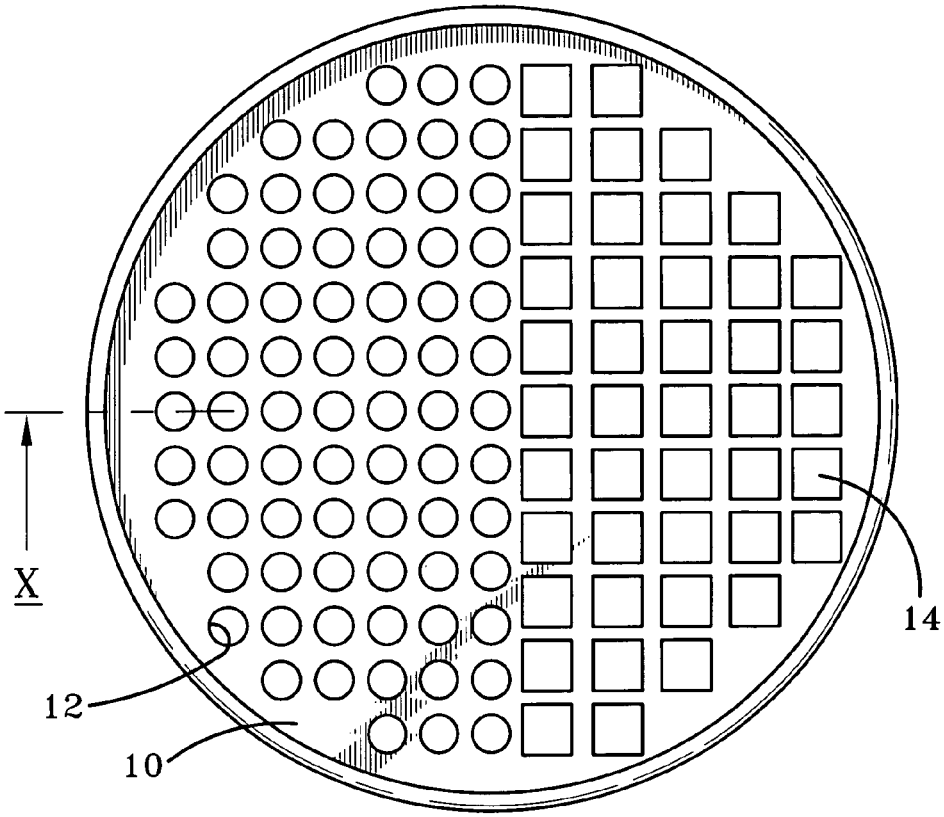
FIG. 3 is a plan view of a molded hand exerciser of the present invention showing two different shaped apertures on the same exerciser; and, FIG. 4 is a plan view of a molded hand exerciser of the present invention showing a different shape aperture.
Figure 4:
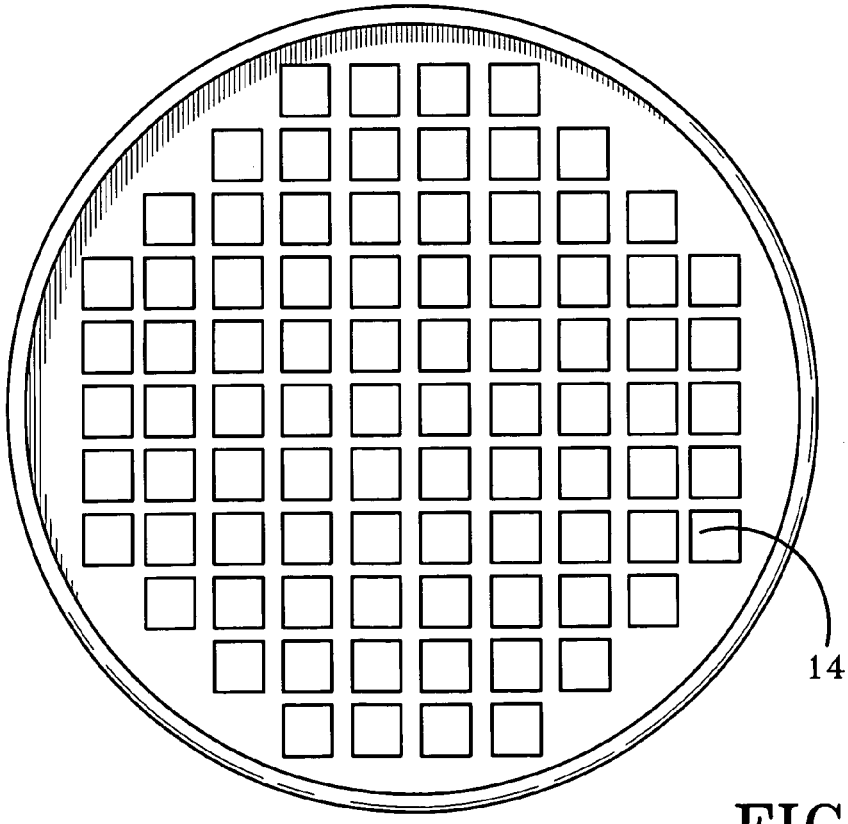

In addition, FIG. 1 shows the preferred embodiment with circular shaped apertures 12. The aperture shape also contributes to the exercise features of the present invention. The apertures may be square 14 as shown in FIG. 4 or triangular (not shown), rectangular (not shown), hexagonal (not shown) or any geometric shape chosen with sound engineering judgment. In addition, as illustrated in FIG. 3 a portion of the apertures can be of one shape and another portion of the apertures can be of a different shape. As the user inserts and removes his or her fingers from the apertures the user will experience a certain degree of resistance. The amount of resistance will depend on the size and shape of the aperture in relation to the size of the user's fingers. A tighter fit will result in a greater resistance than will a loose fit.

In order to utilize the hand exerciser of the present invention, the fingers are inserted into the apertures 12. As resistance is applied to the fingers by the web 13, appropriate muscle groups are employed to overcome this resistance. Thus, by using one or both hands, twisting, pulling, pushing movements may be applied to the hand exerciser. By using one or more fingers it is possible to contract the web 13 in various ways in carrying out scissor movements, curling and related motions. Also, more than one individual may use the device simultaneously wherein each person places their fingers into the cells in one area of the grid and then applying tension in opposite directions.

The hand exerciser of the invention is a useful accessory for sufferers of arthritis and rheumatism and may be used in physiotherapy in hospitals. It may also be used in exercising or training by persons whose sporting activities require the use of the hand and forearms, wrist and fingers and is expected to be of special benefit to persons who play golf, cricket, tennis, judo, gymnastics, baseball, swimming, skiing, wind surfing and mountaineering. It is conservatively estimated that over twenty exercises can be performed efficiently with the hand exercisers of the invention, as well as approximately thirty physiotherapy-training principles.

The following list of exercises is indicative of those that may be carried out using an exerciser embodying the invention:

1. Insert fingers of hand or hands into elastic grid provided by the web and grip and contract repeatedly.
2. Insert fingers of hand closely spaced into grid and expand outwards, i.e. the opposite of Exercise 1.
3. Insert fingers of one or both hands in an open scissors position into the grid and contract, or use two fingers at a time, one or both hands.
4. Insert fingers in a closed scissors position and expand repeatedly i.e. the opposite of Exercise 3.
5. Insert fingers or finger of hand or hands into grid for curling action, with back of hand resting on the rigid frame.
6. Place palm of hand on the frame and insert thumb into grid and expand outwards.
7. Hold the frame with four fingers of one hand, then use the thumb to contract the grid towards the frame.
8. Hold the frame with four fingers of one hand, then move the thumb to left and right; the thumb can also push down on the grid and achieve the reverse effect.
9. Place the palm of the hand on the frame and grip the grid with the fingers extended and contract. One or more fingers and the hand or hands can be exercised simultaneously. To achieve higher resistance, insert the fingers further away from the frame into the grid then, stretch the grid back until palm of the hand can be anchored to the frame. Alternatively, both hands can be used to contract the grid simultaneously in opposite directions.

10. Place the fingers of one hand underneath one side of the grid, then place a finger from the other hand on top of the other side of the grid and push down with one finger and up with the other.

11. Insert fingers of one hand in a scissor position into the grid, then with the other hand hold the frame and rotate the frame in a circular motion left to right resisting the movement with the inserted hand. A back and forth motion can also be utilized. A variation is to hold the frame firm in one hand and with the other inserted in the scissor position twist the hand left to right and up and down.

12. Insert two fingers or more into the grid and while keeping them stiff move them up and down in a vertical plane. The other hand holds the exerciser steady.

13. Insert a finger into the grid using the frame to anchor the thumb then, while holding the frame steady with the other hand, move the finger in a circular clockwise and anti-clockwise movement.

14. With the exerciser in a horizontal position insert the fingers from underneath through the grid so that the finger tips are positioned on the frame, then while holding the frame firm with the free hand, pull with the fingers raising the knuckles upwards, as if pulling oneself up the edge of a cliff with the finger tips. The free hand that keeps the exerciser steady can also be used to put the grid under tension by contracting the grid and thus increasing the resistance to the exercising hand.

15. The reverse of the above exercise is achieved by placing the frame in the palm of the hand, then inserting the fingers into the upper side of the grid and then pulling or raising the fingers backwards repeatedly.

16. Place the web in the palm of the hand and use the fingers to "walk" pulling successive rows of cells towards the frame and back again to the starting position.

17. With both hands grip the grid and place the frame of the exerciser against the knees and turn the hands downwards.

18. As in Exercise 17, position the frame against the knees and grip the grid and twist in circular motion clockwise and anti-clockwise.

19. The grid is gripped with both hands and the moment of bending is applied as in bending a stick. The exerciser is in the vertical position.

20. Grip the grid with the wrists turned to the side so that the thumbs are laterally upright, then raise the hands up and down as if using a hammer.

21. Place the fingers of both hands on the frame then use the thumbs to "walk" backwards, pulling successive rows of the grid towards the frame and back to the starting position.

22. Two or more people can use the web at once contracting alternately in sequence or simultaneously.

As a guideline with regard to schedules on the web, choose 3–5 exercises and do sets of them and repeat for at least 5 minutes 2–3 times per week, more often if higher performance levels are desired. After 6–8 weeks the muscles will need a change of routine and appropriate exercises may be chosen to make up a new schedule.

Many more variations and combinations of the exercises described here can be carried out. Practically every known physical training principle can be utilized on the exerciser, i.e. super sets, tri sets overload, forced reps, pyramids etc.

At least one embodiment been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

What is claimed is:

1. A hand-held exercise apparatus comprising:

a rigid frame;

a resiliently deformable web tensioned to the frame, the web being comprised of an array of apertures sized to accommodate human fingers, wherein the web has at least a first portion and at least a second portion, wherein the first portion is made of a first material and the second portion is made of a second material, wherein the first material has a different resistance level than the second material, wherein the apertures on the at least a first portion are a different shape than the apertures on the at least a second portion, and the different shapes have different resistance levels, wherein the at least a first portion has a resistance level which is different from the resistance of the at least a second portion by a factor of at least two.

2. The apparatus of claim 1, wherein the web has multiple portions, wherein each portion is made of different material, wherein each different material has a different resistance level.

3. The apparatus of claim 2, wherein the web is molded around the frame.

4. The apparatus of claim 1, wherein the web has multiple portions, wherein each portion's apertures are a different shape than the apertures on the other portions.

5. A method for exercising, the method comprising the steps of:

providing a hand-held web with at least a first portion and at least a second portion, wherein the first portion is made of a first material and the second portion is made of a second material, wherein the first material has a different resistance level than the second material;

molding the web onto a substantially rigid hand-held frame;

inserting associated fingers into apertures, wherein the apertures of the first and second portions are different shapes with different resistance levels;

pulling the web toward an associated body; and, releasing the tension on the web.

6. The method of claim 5, wherein providing a web with at least a first portion and at least a second portion, wherein the first portion is made of a first material and the second portion is made of a second material, wherein the first material has a different resistance level than the second material further comprises the step of:

providing a web with multiple portions, wherein the portions are made of materials with different resistance levels.

7. The method of claim 5, wherein providing a web with at least a first portion and at least a second portion, wherein the apertures of the first and second portions are different shapes with different resistance levels further comprises the step of:

providing a web with multiple portions, wherein the apertures of the portions are different shapes with different resistance levels.

8. A hand-held exercise apparatus comprising:

a rigid frame, the frame being capable of being hand-held;

a resiliently deformable web tensioned to the frame, the web being comprised of an array of apertures sized to accommodate human fingers, wherein the web has at least a first portion and at least a second portion, wherein the first portion is made of a first material and the second portion is made of a second material, wherein the first material has a different elasticity modulus than the second material, wherein the apertures on the at least a first portion are a different shape than the apertures on the at least a second portion, and the different shapes have different elasticity moduli.

9. The apparatus of claim 8, wherein the first material has an elasticity modulus that is approximately twice the elasticity modulus of the second material.

10. The apparatus of claim 8, wherein the web has multiple portions, wherein each portion is made of different material, wherein each different material has a different elasticity modulus.

11. The apparatus of claim 10, wherein at least one of the portions has a material that has an elasticity modulus that is approximately twice the elasticity modulus of at least one other portion.

12. The apparatus of claim 8, wherein the web has multiple portions, wherein each portion's apertures are a different shape than the apertures on the other portions.

13. The apparatus of claim 11, wherein the material of the first portion has an elasticity modulus of approximately 3 $MN/m^2$ and the material of the second portion has an elasticity modulus of approximately 6 $MN/m^2$.

14. The apparatus of claim 10, wherein the different portions have an elasticity modulus of from between approximately 1 $MN/m^2$ to approximately 10 $MN/m^2$.

* * * * *